United States Patent [19]

Wood

[11] 4,450,879

[45] May 29, 1984

[54] MODULAR FLUID DISPENSING NOZZLE

[75] Inventor: Chester W. Wood, Milford, Ohio

[73] Assignee: Dover Corporation, New York, N.Y.

[21] Appl. No.: 399,691

[22] Filed: Jul. 19, 1982

Related U.S. Application Data

[63] Continuation of Ser. No. 218,634, Dec. 22, 1980, abandoned.

[51] Int. Cl.[3] ..... B67D 5/04

[52] U.S. Cl. ..... 141/209; 29/469; 222/575; 251/152

[58] Field of Search ..... 29/469; 141/1, 98, 206, 141/207, 208, 209, 210, 211, 212, 213, 214, 215, 216, 217, 218, 219, 220, 221, 222, 223, 224, 225, 226, 227, 228, 229; 222/288, 575; 251/152

[56] References Cited

U.S. PATENT DOCUMENTS 2,528,697 11/1950 Logan et al. ..... 141/209
3,323,560 6/1967 Ehlers ..... 141/219 X

FOREIGN PATENT DOCUMENTS 770706 2/1955 United Kingdom ..... 141/209

*Primary Examiner*—Stephen Marcus
*Assistant Examiner*—Mark Thronson
*Attorney, Agent, or Firm*—Kinney and Schenk

[57] ABSTRACT

A modular dispensing nozzle particularly adapted for dispensing gasoline and constructed for easy repair and low pressure drop is provided with a novel automatic shut-off mechanism which terminates fluid flow through the nozzle in response to predetermined conditions.

38 Claims, 26 Drawing Figures

MODULAR FLUID DISPENSING NOZZLE

This is a continuation of application Ser. No. 218,634, filed Dec. 22, 1980, abandoned.

BACKGROUND

The invention relates generally to dispensing nozzles and more particularly concerns dispensing nozzles of the type used to dispense liquid. The invention will be specifically disclosed in connection with a gasoline dispensing nozzle with an automatic shut-off mechanism which terminates flow from the nozzle whenever a liquid level in a fill tank reaches a predetermined level.

Dispensing nozzles are in wide spread use today which commonly dispense gasoline into fill tanks of automobiles and other vehicles. These nozzles generally consist of a nozzle body with an internal flow passage extending through the body. The inlet of the nozzle is connected to a hose, usually formed of rubber, which communicates with a pressurized source of gasoline. The gasoline, under pressure created by a pump, passes through the nozzle body to a spout which is attached to the outlet or discharge end of the nozzle body. The spout is normally inserted into a vehicle fill tank prior to and during the period in which fluid is being dispensed from the nozzle. In gasoline dispensing nozzles, it is common for the flow through the nozzle's internal flow passage to be controlled by a valve which is, in turn, actuated by a manually operated lever.

The quantity of gasoline dispensed from a nozzle is almost always measured, most commonly with the measured quantity being visually displayed upon the gasoline pump face. Also displayed visually upon the pump face is the cost, at the prevailing rates, of the measured and dispensed quantity of gasoline. Irrespective of whether gasoline is dispensed by a service station attendant or a consumer, the quantity purchased is frequently that which represents a specific amount of money.

Due to the escalation of gasoline prices in recent years, the quantity of gasoline represented by a specific amount of money has decreased substantially. As a result, the operator who is dispensing gasoline is required to terminate dispensing between increasingly small incremental amounts of gasoline. For example, in the United States, the smallest incremental unit of money is a penny ($0.01) or one cent. If a consumer in the United States desired to purchase a quantity of gasoline corresponding to exactly one dollar ($1.00) in value, the operator would be required to terminate fluid flow through the nozzle when the value of the dispensed gasoline was midway between 99 cents ($0.99) and one dollar and one cent ($1.01). It should be readily apparent that this incremental amount of gasoline varies in inverse correspondency to the price of gasoline. In other words, as the price of gasoline goes up, the quantity of gasoline represented by a specific incremental amount of money decreases.

In some circumstances, it is also desirable to reduce flow resistance through the nozzle's internal flow passage. Reducing flow resistance will reduce the pressure drop across the nozzle and, inter alia, make it easier to terminate flow by small increments.

Another problem which inevitably arises in the operation of a gasoline service station is the repair of gasoline dispensing nozzles. Although nozzle malfunctions are relatively rare, the occurrence of a malfunction in a nozzle may require the service station attendant to completely shut down a gasoline pump. This problem is compounded by the complexity of modern day nozzles which frequently make immediate repair by the service station attendant improbable. This is because repair often requires special tools and equipment or because the repair is beyond the technical competence of the service station attendant. As a result, the service station attendant is often required to ship the entire nozzle assembly back to the factory for repair. The nozzle of the present invention uses a modular construction which permits replacement of one of several modules and overcomes these problems.

Accordingly, it is an object of the present invention to provide a dispensing nozzle through which fluid flow rate may be reduced to a very small level to dispense liquids in small incremental quantities.

It is another object of the present invention to reduce the pressure drop through a dispensing nozzle.

It is a further object of this invention to provide a dispensing nozzle which is readily and simply repairable in the field without the use of special tools.

It is a further object of the present invention to provide a dispensing nozzle which is modular in design and construction for easy repair.

SUMMARY OF THE INVENTION

In accordance with one aspect of the invention, a dispensing nozzle with an automatic shut-off mechanism includes a nozzle body having an internal flow passage with a valve disposed therein for selectively blocking fluid flow therethrough. The valve is movable between an open position in which fluid flow through the internal flow passage is permitted and a closed position in which the fluid flow through the internal flow passage is substantially blocked. An actuator is provided for moving the valve between the open and closed positions under predetermined conditions. A shut-off mechanism is also provided for moving the valve under certain predetermined conditions to the closed position irrespective of the position of the actuator. This shut-off mechanism includes a plurality of independently rotatable members which are coupleable for common rotational movement in response to movement of the actuator. Means are also provided for uncoupling the independently rotatable members in response to the certain predetermined conditions and rotating one of the rotatable members relative to the other when the independently rotatable members are uncoupled. This rotation moves the valve to the closed position irrespective of the position of the actuator.

In accordance to a further aspect of the invention, a dispensing nozzle is provided with a nozzle body having an internal flow passage. A valve is movably disposed in the internal flow passage for selectively blocking fluid flow therethrough. A stop which is movable in response to predetermined conditions is provided for selective engagement with a retaining surface. A first linkage is rotatably connected to the nozzle at a first location about a first axis. This first linkage has an engagement surface for contact by an actuator on a portion remote from the connection with the nozzle body. A second linkage is pivotally connected to the first linkage by the second axis substantially parallel to the first axis at a location intermediate of the first linkage's engagement surface and the first linkage's connection to the nozzle body. This second linkage has a retaining surface which is selectively engagable by the movable stop, and when so engaged, retains the surface and causes it to rotate about the first axis. Means are also provided for rotating the second linkage relative to the first linkage about the second axis when the movable stop is disengaged from the retaining surface. The movement of the second linkage is translated into movement of the valve in a direction substantially perpendicular to the first and second axis.

In accordance to a still further aspect of the invention, a dispensing nozzle is provided having a body with an internal flow passage. Valve means are disposed within the internal flow passage for selectively blocking fluid flow therethrough. The valve means is movable between open and closed positions which correspond to open and closed positions of an actuator. In the absence of predetermined conditions, the valve means are controlled by the actuator. A mechanism is also provided for releasing the valve means from control of the actuator in response to these predetermined conditions. This mechanism for releasing the valve from control of the actuator is self-contained within a cartridge or carrier housing for common removal with the cartridge from the nozzle body.

In accordance with yet another aspect of the invention, a dispensing nozzle of modular construction is provided. This modular construction includes a nozzle body having an internal flow passage with a valve assembly releasably fitted within the internal flow passage. The valve assembly includes a valve movable between open and closed positions to selectively permit fluid flow through the internal flow passage and this valve assembly is contained within a valve cartridge for common removal of the valve assembly with the cartridge from the internal flow passage. A shut-off mechanism is movably positioned within the nozzle and operative to move the valve to its open position in response to movement of an actuator under predetermined conditions. The shut-off mechanism is contained within a carrier housing for common removal with the carrier housing from the nozzle body. A guard member is releasably secured to the nozzle body subjacent to the shut-off mechanism and the actuator is pivotally connected to the guard member, and, when assembled, extends through the bottom opening of the carrier housing to interact with the shut-off mechanism. The actuator is unsecured to the nozzle body or the shut-off mechanism and is removable from the nozzle body with the guard member.

BRIEF DESCRIPTION OF THE DRAWINGS

Other objects and advantages of the invention will become apparent upon reading the following detailed description and upon reference to the drawings, in which.

While the invention will be described in connection with preferred embodiments, it will be understood that it is not intended to limit the invention to those embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

Figure 1:
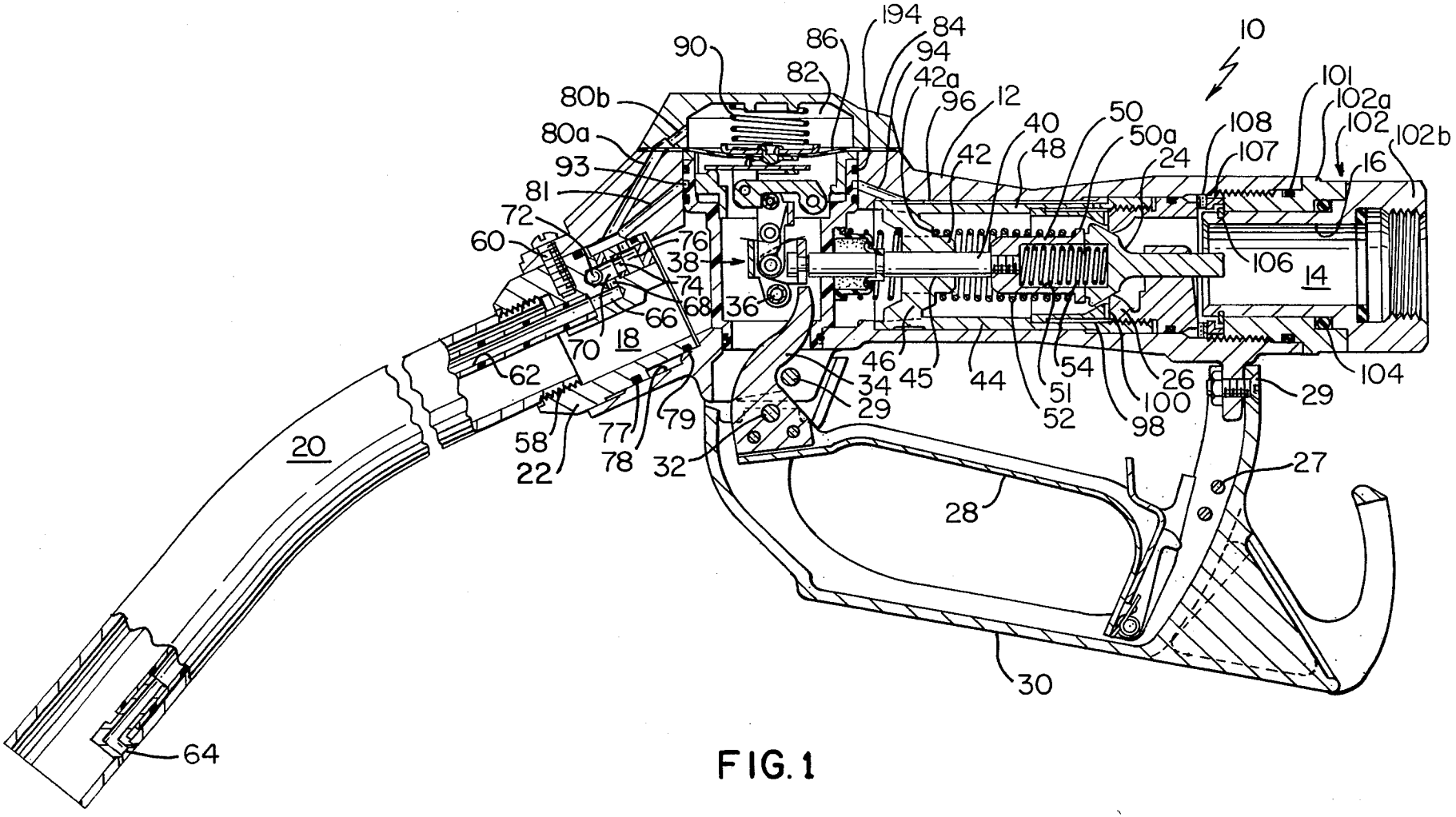
FIG. 1 is an elevational view, partially in cross section, of one form of dispensing nozzle made in accordance to the present invention with the actuating and automatic shut-off mechanism depicted in a relaxed closed position.
Figure 2:
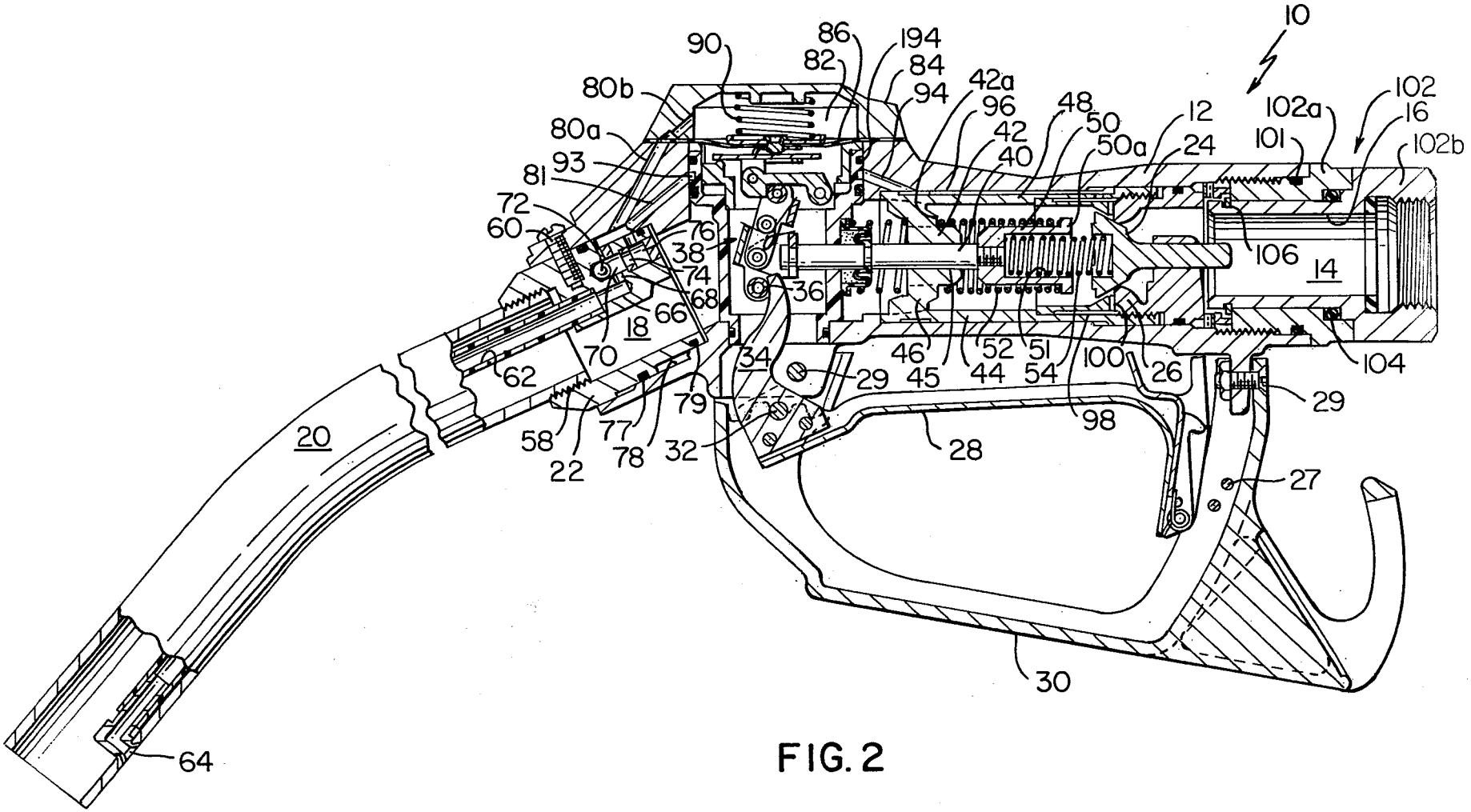
FIG. 2 is an elevational view, partially in cross section, of the dispensing nozzle of FIG. 1 with the actuating and automatic shut-off mechanism depicted in fully open position.
Figure 3:
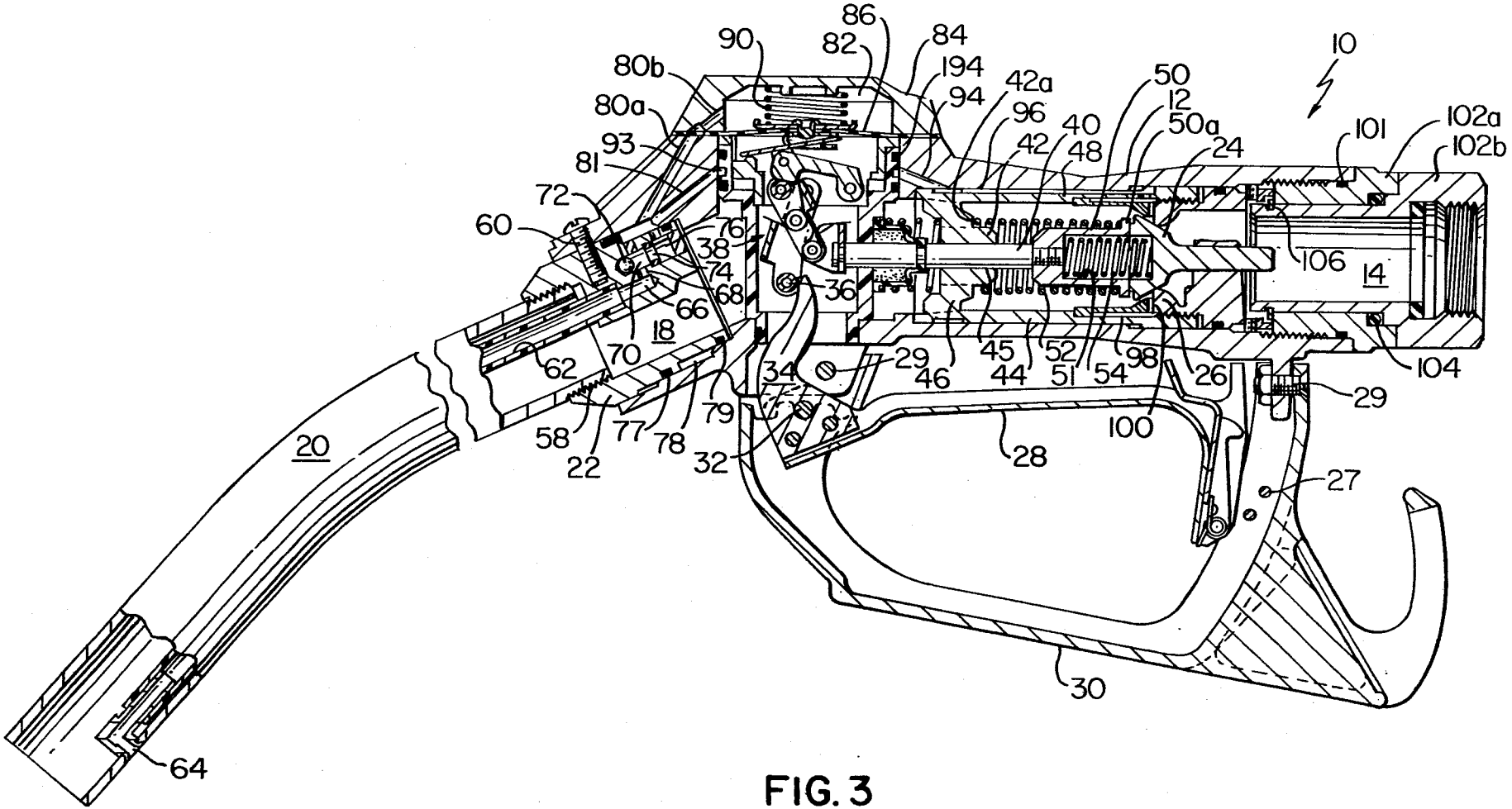
FIG. 3 is an elevational view, partially in cross section of the dispensing nozzle of FIG. 1 with the actuating member in open condition and automatic shut-off mechanism released with the poppet valve in the closed position.

Referring now to the drawings and to FIGS. 1–3 in particular, a gasoline dispensing nozzle generally designated by the numeral 10 is shown. The nozzle 10 includes a body portion 12 which has an internal flow passage 14 which extends through the body 12 from an inlet opening 16 to an outlet opening 18. A spout 20 is secured to the nozzle 12 at the outlet opening 18 through the agency of a spout adapter 22.

Fluid flow through the nozzle's internal flow passage 14 is controlled by a poppet valve 24 which is axially and reciprocally movable within the internal flow passage 14 between a first closed or seated position against a valve seat 26 (illustrated in FIGS. 1–3) and a second open or unseated position in which the valve 24 is moved to an open position (not shown). This movement of the valve 24 is achieved through the use of a manual lever 28, which lever 28 is pivotally secured to a guard 30 fastened to the nozzle body 12 by suitable fastening means 29, preferably nuts and bolts.

When the lever 28 is compressed relative to the body 12, it rotates counterclockwise about a pivot pin 32 to move a rigidly attached cam 34 into contact with an engagement surface in the form of a roller 36 of an automatic shut-off mechanism 38, the details of which will be discussed later. The movement of the automatic shut-off mechanism by the cam 34 (which, together with lever 28 forms an actuator) is translated into axial movement of a valve stem 40. This valve stem 40 extends through a spider type stem guide 42 of a body chamber module or cartridge 44. The stem guide 42 has an opening 45 designed to receive and support the stem 40. This opening 45 is centrally disposed within the internal flow passage 14 in axial alignment with the longitudinal axis of the body chamber module or cartridge 44 and is supported by a plurality of supports 46 extending radially inward from a sleeve or outer housing portion 48 of the body chamber module or cartridge 44. An end portion of valve stem 40, distal to the automatic shut-off mechanism 38, is generally cup shaped to form a thimble type member 50 with a closed end internal spring receptive cavity 51. This end portion or thimble 50 is normally biased rightwardly in the illustration by a first compression spring 52, the spring 52 being positioned between an underside of an annular flange **50*a* of the cup shaped end portion or thimble 50 and a shoulder 42*a* of the stem guide 42. In this illustrated position, the compression spring 52 biases the annular flange 50*a* into abutment with the poppet valve 24 to maintain the valve 24 in its closed or seated position against seat 26**.

A second compression spring 54 is located in the thimble's internal spring receptive cavity 51 to urge valve 24 away from the thimble 50. As will be explained in greater detail later, the second compression spring 54 urges the valve 24 to a closed or seated position whenever the valve stem 40 has been moved leftwardly (in the illustration) and the back pressure of the fluid in the internal flow passage 14 upstream of the valve 24 falls below a level necessary to overcome the bias of spring 54.

The spout 20 is threadably received in the spout adapter 22 by threads 58 and placed in fluid communication with the internal flow passage 14. The spout adapter 22 is, in turn, sealingly fitted into the nozzle outlet 18 where it is secured by a screw 60 extending into the spout adapter 22 through the nozzle body 12. As is usual for gasoline dispensing nozzles, the spout 20 has a liquid level sensing line 62 which is normally exposed to the atmosphere through an opening 64 near the end of the spout 20 distal to the spout adapter 22. The opposite end of the liquid level sensing line (opposite the opening 64) leads to a pair of successive passages 66 and 68 in the spout adapter 22. In the illustrated embodiment, the second of this pair of passages 68 is in fluid communication with an attitude chamber 70 containing a ball 72. This ball 72 is movable from one end of the attitude chamber 70 to the other but is constrained by its size from movement beyond the chamber 70. The attitude chamber 70 also communicates with a passage 74, which, like passage 68, has a diametral dimension less than that of the ball 72. The passage 74 communicates with a chamber 76 which, in turn, communicates with an annular chamber 78 through a connecting passage 75, the annular chamber 78 being interposed between the spout adapter 22 and the nozzle body 12. Annular chamber 78 is sealed on opposite sides by O-rings 77 and 79 and is in open communication with a chamber 82 through joining adjacent passages **80*a* and 80*b*, the passage 80*a* being in the body 12 and the passage 80*b* being in a cap 84 secured atop the nozzle body 12** by suitable fastening elements such as screws (not shown).

Chamber 82 is formed between the cap 84 and a diaphragm 86 which provides an air seal between the chamber 82 and the automatic shut-off mechanism 38 which is positioned beneath the diaphragm 86. A compression spring 90 is centrally disposed within the chamber 82 to urge the central portion of the diaphragm 86 downwardly. As will be explained in detail later, the automatic shut-off mechanism is interconnected to the diaphragm 86.

A further passageway 81 provides communication between the annular chamber 78 and an annular groove or passageway 93 about the periphery of a carrier housing 159. This passageway 93 communicates with another passageway 94 which, in turn, communicates with a venturi located next to the poppet valve 24 by way of a passage 96 formed in the outer sidewall 48 of the body module 44. The passage 96 communicates with an annular chamber 98 which in turn communicates with a venturi passage 100 adjacent seat 26.

The nozzle body 12 is connected to rubber hose (not shown) which leads to a pressurized source of gasoline. This connection is by way of a swivel 102 consisting of a base portion **102*a*, threadably received by the nozzle body 12, and a tail portion 102*b* rotatably fitted to the base portion 102*a*. An O-ring 101 is interposed between the base portion 102 and the nozzle body 12 for sealing purposes. Similarly, an O-ring 104 is interposed between the base and tail portions 102*a* and 102*b* to provide a fluid seal between those two elements while at the same time, permitting relative rotary motion therebetween. The tail portion 102*b* receives the rubber hose (not shown) to which it is firmly attached. The relative movement permitted between the base 102*a* and the tail 102*b* portions of the swivel 102 thus provides for relative rotary motion between the nozzle body 12 and the hose (not shown) which delivers pressurized gasoline from a pump (not shown). A retaining ring 106 is fitted within an external annular groove in tail portion 102*b* to prevent relative axial movement between the two swivel components 102*a* and 102*b*. A spacer 107 is also circumferentially disposed about the axially inbound end of tail portion 102*b* between the base portion 102*b* and a wave spring 108. The spacer not only contains the ring 106 within its annular groove, it provides an axial thrust against the wave spring 108 to urge the body module 44** leftwardly in the illustration.

Figure 4A:
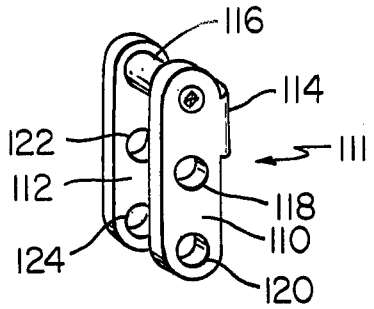
FIGS. 4*a* through 4*g* depict various stages of the construction of a latch module which includes the automatic shut-off mechanism used in the dispensing nozzle of FIGS. 1–3.

The automatic shut-off mechanism 38 of FIGS. 1–3 and its components are shown in greater detail in FIGS. **4*a* through 4*g*, and FIGS. 5–11. FIG. 4*a* shows a second linkage member 111 which consists of a pair of individual elongated links 110 and 112 joined by a spanning bridge member 114 which rigidly connects and aligns the individual links 110 and 112. The elongated links 110 and 112 are also joined by a roller 116 proximal to one end of each of the links 110 and 112. Each of the links 110 and 112 also has a pair of apertures which are aligned with a corresponding aperture in the other link, apertures 118 and 120 in link 110 being aligned with apertures 122 and 124 in link 112. The spanning bridge member 114 and the roller 116** hold the links in aligned, spaced, parallel relationship.

Figure 4B:
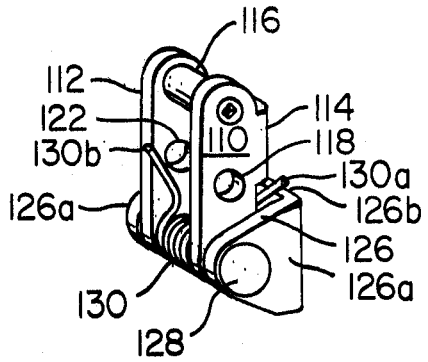

As shown in the depiction of FIG. 4*b*, the aligned, spaced, parallel links 110 and 112 which form the second linkage member 111 are rotatably attached to a connecting member in the form of a yoke 126. The yoke consists fo a pair of sidewalls 126*a* which are spanned by a cross piece 126*b*. The second linkage member 111 is attached to the yoke 126 through the agency of a connecting pin 128 which passes through aligned apertures 120 and 124 in the links 110 and 112 respectively and through correspondingly aligned apertures in the yoke sidewalls 126*a*, which sidewalls 126*a* are disposed outside the links 110 and 112 in parallel relationship thereto. A spring 130 is coiled about connecting pin 128 with one end 130*a* disposed about the cross piece 126*b*. The other end 130*b* of spring 130 is shown extending into space in FIG. 4*b*. This other end 130*b* will be biased against a connecting member extending through apertures 118 and 122 in later assembly.

Figure 4C:
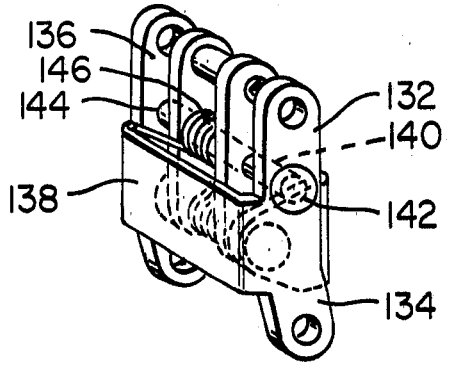

FIG. 4*c* shows the sub-assembly of FIG. 4*b* disposed within a first linkage member or anchor 132. The anchor 132 includes a pair of links 134 and 136 which are in parallel spaced aligned relationship to links 110 and 112. These parallel links 134 and 136 are spaced by a cross portion 138 which rigidly joins each of the links 134 and 136 near their mid-sections. The links 134 and 136 have aligned apertures 142 and 144 disposed slightly above their mid-sections. A pin 140 extends through these apertures 142 and 144 and through apertures 118 and 122 in links 110 and 112 which are interiorly disposed with respect to the links 134 and 136. The connecting pin 140 thus secures the sub-assembly of FIG. 4*b* to the anchor 132 in a manner which permits relative rotational movement between the entire FIG. 4*b* sub-assembly and the anchor 132.

A spring 146 is coiled about a portion of the pin 140 extending between links 110 and 112. The function of the spring 146 is to bias the FIG. 4*b* sub-assembly into a predetermined relative angular position with respect to the anchor 132, this predetermined position being that illustrated in FIG. 4*c*.

Figure 4D:
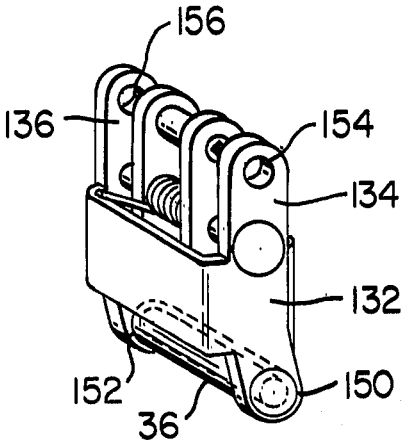

FIG. 4*d* depicts a sub-assembly of FIG. 4*c* with the addition of the roller 36 (which was discussed, supra, in connection with FIG. 1) extending from link 134 to link 136 through apertures 150 and 152 respectively near the bottom of these links 134 and 136. Due to the positioning of the FIG. 4*b* sub-assembly with respect to the first linkage or anchor 132, the roller 36 is positioned below the FIG. 4*b* sub-assembly. The links 134 and 136 also have apertures 154 and 156 near their top portions. When the FIG. 4*b* sub-assembly is positioned as illustrated in FIGS. 4*c* and 4*d* with respect to the anchor 132, these apertures 154 and 156 are in alignment with the roller 116 extending between links 110 and 112.

Figure 4E:
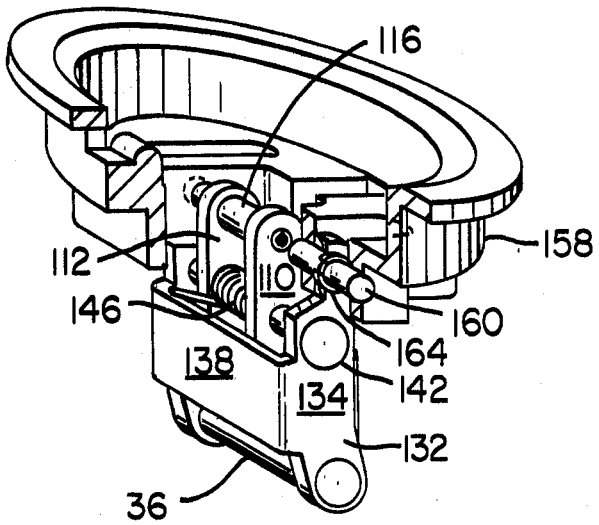

As seen in FIG. 4*e*, the sub-assembly of FIG. 4*d* is disposed within a latch module housing 158. It is retained in the latch module housing 158 by a pair of pins 160 and 162 (pin 162 is not illustrated in FIG. 4*e*, see FIG. 9) which extend from the latch module housing 158 through the previously described apertures 154 and 156 to provide a rotatable movable connection between the first linkage or anchor 132 and latch module housing 158. As illustrated in FIG. 4*e*, the pins 160 and 162 have axes which are coincident with the axis of roller 116. Each of the pins 160 and 162 have a retaining ring to maintain the pins' (160 and 162) position. Only retaining ring 164 on pin 160 is illustrated in FIG. 4*e*. However, pin 162 contains a similar retainer ring 165 (see FIG. 9).

Figure 4F:
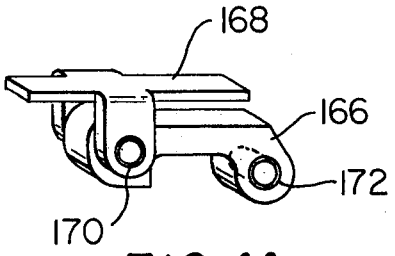
Figure 4G:
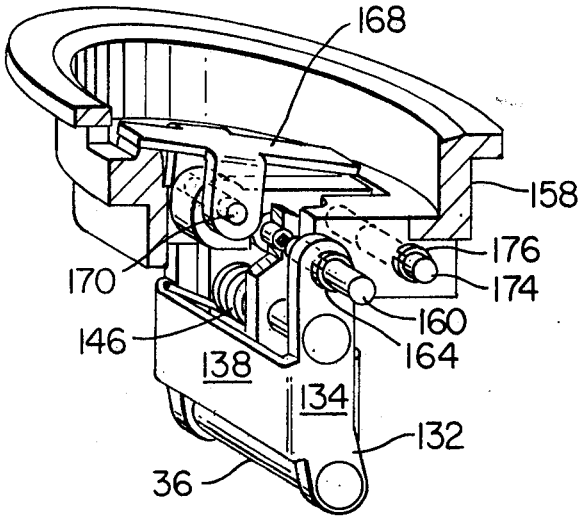

FIG. 4*f* depicts a clevis 166 and a fulcrum 168 which is secured to the clevis 166 in rotatably movable interrelationship by a connecting pin 170. The clevis 166 also has another opening 172 at its end which is opposite to the end with the connection with fulcrum 168 by pin 170. In FIG. 4*g* it is seen that the clevis 166 is rotatably secured to the latch module housing 158 by a further connecting pin 174 extending through this opening 172. A retainer ring 176 is also illustrated on connecting pin 174 to keep the pin 174 in its desired position. As shown in FIG. 4*g*, the clevis 166 pivots about the pin 174, which movement permits it to selectively drop down over roller 116. When so dropped down over roller 116, the clevis 166 engages roller 116 and prevents counterclockwise rotation of the roller other than about its own axis.

Figure 5:
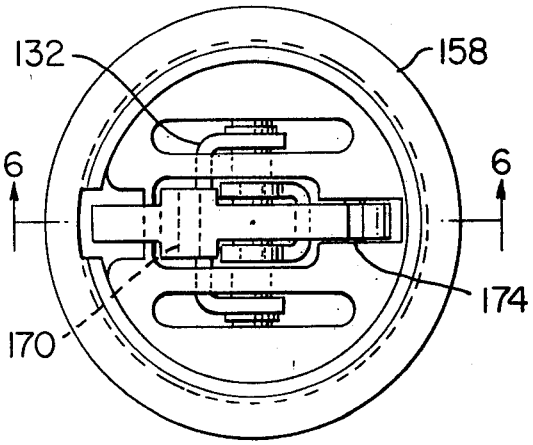
FIG. 5 is a plan view of the latch module depicted in FIG. 4*g*.

FIG. 5 shows the latch module housing 158 in plan view to illustrate the interrelationship of the previously discussed elements contained therein. These same elements are illustrated in the cross sectional elevational view of FIG. 6. As explained above, these illustrated elements secured to the latch module housing 158 partially comprise the shut-off mechansim 38 in their relative positions which correspond to the relaxed nozzle position depicted in FIG. 1.

Figure 7:
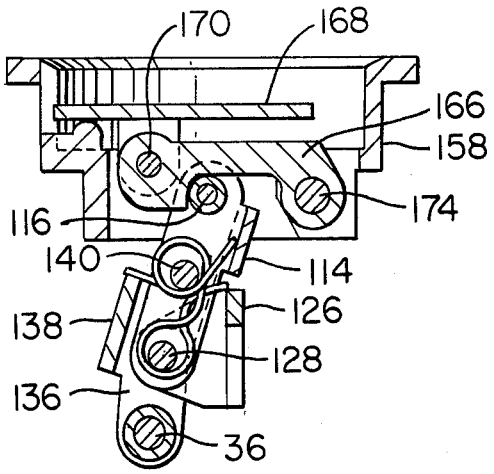
FIG. 7 is a sectional view similar to FIG. 6 but showing the automatic shut-off mechanism in an open position.

When it is desired to dispense gasoline from the nozzle, the manual lever 28 (FIGS. 1–3) is compressed toward the nozzle body 12 to pivot the lever 28 about pivot pin 32. This forces the cam 34 to contact and move roller 36 on the shut-off mechanism 38 as the cam 34 is rotated counterclockwise about pivot pin 32. This counterclockwise movement of the cam 34 results in clockwise rotation of the anchor 132, as well as the entire sub-assembly of FIG. 4*b* contained within the first linkage or anchor 132, about a first axis which is coincident with both those of the pivot of roller 116 and pivot pins 160 and 162. This movement of the shut-off mechanism 38 is illustrated in FIG. 7 which corresponds to the position of the shut-off mechanism depicted in the illustration of FIG. 2. As is apparent from the illustration of FIG. 2, clockwise pivoting of the shut-off mechanism 38 about roller 116 moves the valve stem 40 leftwardly, the valve stem 40 being securely connected to yoke 126. This leftward movement of the valve stem results because the second linkage member 111 is securely attached to anchor 132 about connecting pin 140 and roller 116 is prohibited from other than rotational movement about its own axis by the engagement by clevis 166. The engagement of roller 116 by the clevis 166 effectively couples the independently rotatable second linkage member 111 and the anchor 132. The leftward movement of the valve stem 40 removes the cup shaped end thimble 50 of the valve stem 40 away from the poppet valve 24. The poppet valve 24 is urged to the closed position by only compression spring 54. Thus, whenever the back pressure of the gasoline reaches a predetermined level sufficient to overcome spring 54, the poppet valve 24 is moved to an open or unseated position. Thus, even though the poppet valve 24 is shown in the closed or seated position in FIG. 2, the position of the shut-off mechanism 38 represents that of a fully open position.

For reasons which will be discussed later, under certain conditions, the diaphragm 86 (which is connected to the clevis 166) is urged upwardly and this upward movement rotates the clevis 166 about pin 174 to disengage the clevis from the roller 116 and to uncouple anchor 132 from the second linkage 111. Once free of the constraints of clevis 166, the sub-assembly of FIG. 4*b* is rotatable about interconnecting pin 140 under the influence of spring 146. In other words, once uncoupled, the second linkage 111 and anchor 132 are independently rotatable. In addition, compression spring 52 urges the thimble 50 rigidly secured to the stem 40 rightwardly, and the force of this spring is applied to pin 128 which connects the yoke 126 to the second linkage 111. This, of course, applies a counterclockwise moment to the second linkage 111 about connecting pin 140 between the second linkage member 111 and the anchor 132. This causes the second linkage 111 to rotate relative to the anchor 132 about a second axis coincident with the axis of connecting pin 140. This second axis is substantially parallel to the first axis coincident with the axis of roller 116 and pins 160 and 162.

Figure 8:
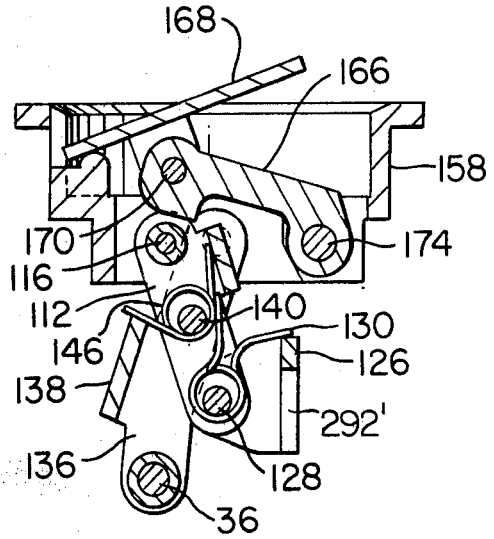
FIG. 8 is a sectional view similar to FIGS. 6 and 7 but showing the automatic shut-off mechanism in a released, shut-off position.

FIG. 8 depicts, in greater detail, the relationship between the various components of the shut-off mechanism 38 in the shut-off position shown in FIG. 3 after the clevis 166 has disengaged the roller 116. In this position, the yoke 126 has moved rightwardly as the second linkage member 111 pivots about connecting pin 140. The valve stem 40 connected to the yoke 126 (see FIG. 3) is thus moved rightwardly in a generally rectilinear fashion and in a direction substantially perpendicular to the first and second axes of the shut-off mechanism 38, forcing the poppet valve 24 into its seated position against the pressurized flow of gasoline flowing through the nozzle 10.

Figure 6:
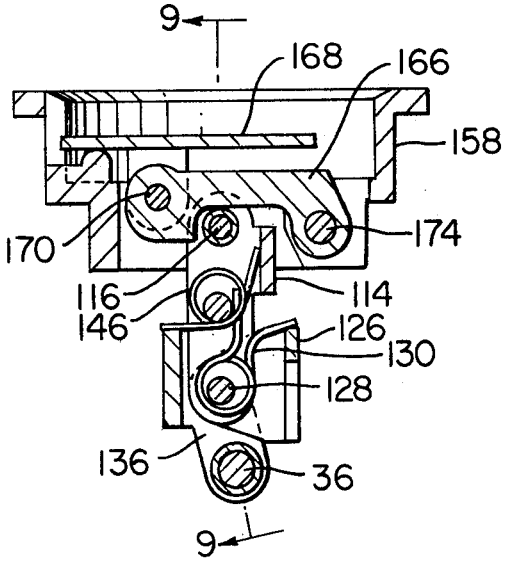
FIG. 6 is a sectional view taken along line 6—6 of FIG. 5 illustrating the automatic shut-off mechanism in a closed position.
Figure 9:
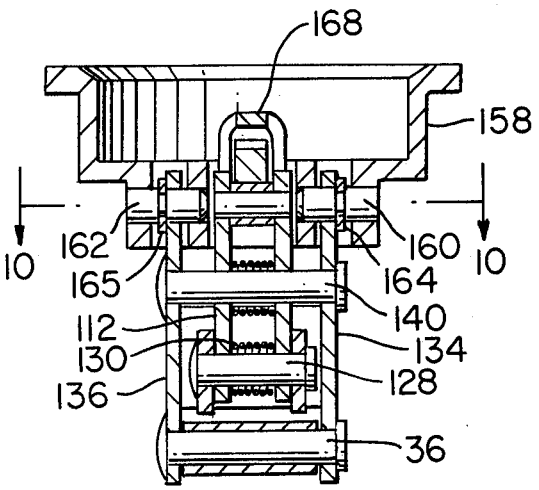
FIG. 9 is a sectional view of the latch module of FIG. 6 taken along line 9—9 of FIG. 6.
Figure 10:
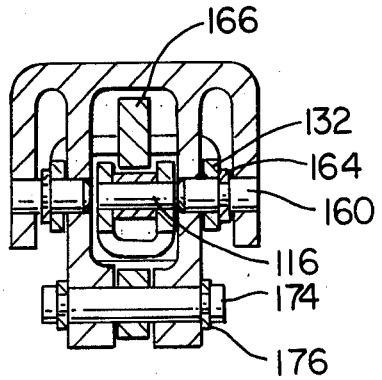
FIG. 10 is a sectional view of the latch module of FIGS. 6 and 9 taken along line 10—10 in FIG. 9.

In FIG. 9, the latch module 158 containing the shut-off mechanism 38 is illustrated in a cross sectional view taken along 9—9 of FIG. 6. FIG. 9 depicts the previously discussed components in a relaxed position (of FIG. 6) from a different angle. FIG. 10 is taken along line 10—10 of FIG. 9 to once again illustrate from a still different angle, the interrelationship of the various components of the shut-off mechanism and their relative positions.

Figure 12:
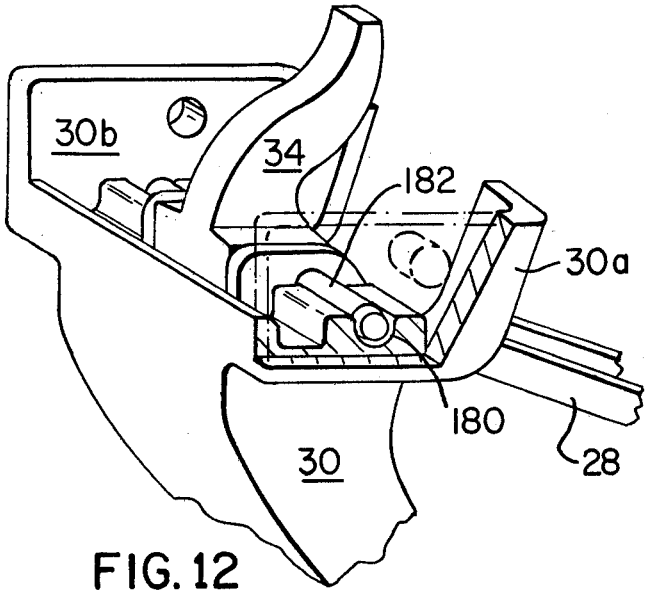
FIG. 12 is a perspective view of the actuating lever and actuating cam in its nesting relationship with the lever guard.

In FIG. 12, the manual actuating lever 28 and the attached actuating cam 34 are shown in a nesting relationship to the guard 30. The guard 30 has an open groove 180 which nestingly receives a pivotal pin 182 which extends through the level 28. Once assembled, the pin 182 is retained in the open groove 180 by the body 12 of the nozzle to which the guard 30 is assembled. As should be implicit from the above description, the guard 30 and lever 28 are assembled prior to attaching the guard 30 to the nozzle body 12.

Figure 11:
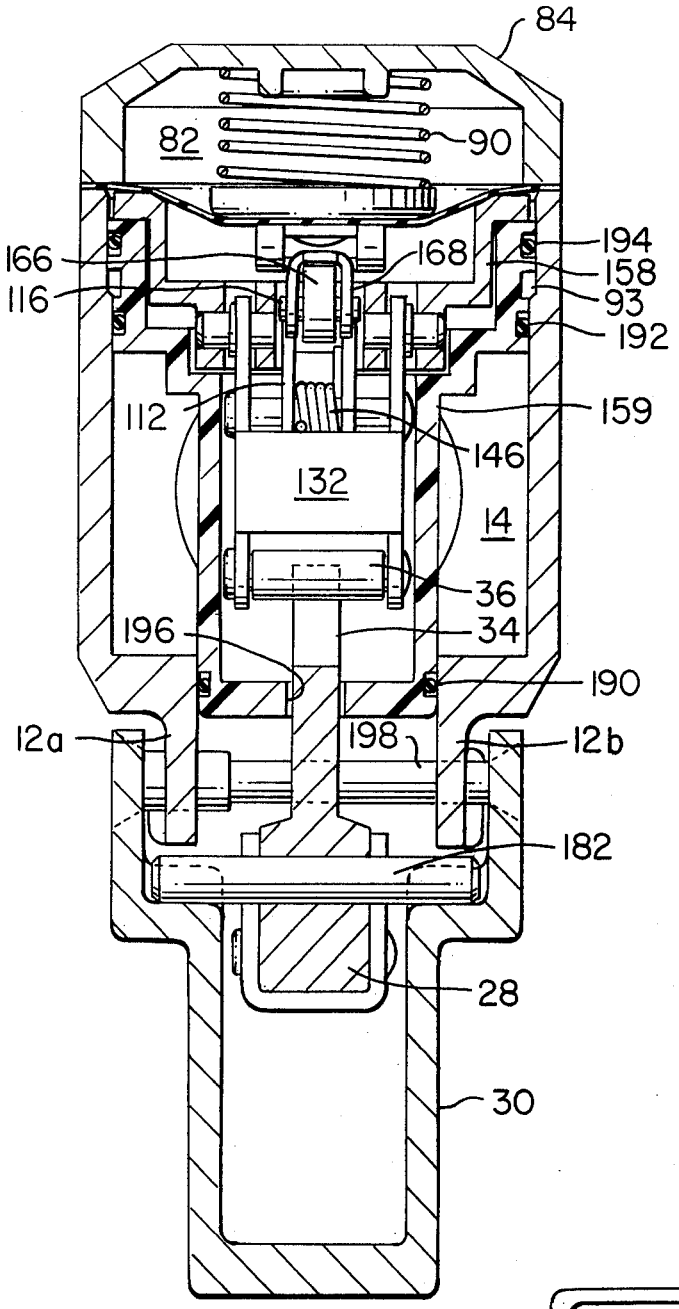
FIG. 11 is a cross sectional end view of the dispensing nozzle illustrating the disposition of the latch module within the nozzle body.

The latch module 158 and the shut-off mechanism 38 partially contained therein are further illustrated in the cross sectional depiction of FIG. 11 as these components would be seen from the spout end of the nozzle. The view shows the latch module 158 disposed in the carrier housing 159, which carrier housing 159 is, in turn, disposed within the internal flow passage 14 of the nozzle 10. The carrier housing 159 has a plurality of liquid seals about its periphery. Proximal to the bottom of the flow passage 14, an O-ring 190 is interposed between the carrier housing 159 and the nozzle body 12. Similarly, a pair of O-rings 192 and 194 circumscribe the top portion of the carrier housing 159 in O-ring receptive grooves. The O-rings 192 and 194 are disposed on opposite sides (bottom and top respectively, in the illustration) of the annular groove or passageway 93 which forms part of the air passageway the opening 64 and the venturi passage 100. It is thus seen that these O-rings 192 and 194 also serve to seal the passageway 93. It is thus seen that the carrier housing 159, with the aid of the aforementioned O-rings, cooperates with the nozzle body 12 to protect the latch module and the partially contained shut-off mechanism from fluid flowing through the internal flow passage 14 to keep the latch module dry.

The carrier housing 159 also has an opening 196 in its bottom portion through which the actuating cam 34 extends for abutment and engagement with the roller 36. The manual lever 28 from which actuating cam 34 extends is, of course, outside of the protective carrier housing 159. However, the opening 196 is beneath the liquid seal formed by the O-ring 190.

As perhaps best realized from a joint viewing of FIGS. 11 and 12, the guard 30 is attached to the nozzle body 12 by a threadable fastening element 198 which extends through aligned apertures in both the guard assembly sidewalls 30*a* and 30*b* as well as downwardly extending flanges 12*a* and 12*b* extending from the nozzle body 12.

Figure 18:
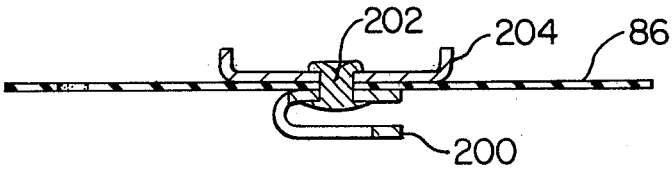
FIG. 18 is a cross sectional elevational view of the diaphragm used in the nozzle of FIGS. 1–3 illustrating an attached connecting member in greater detail.
Figure 19:
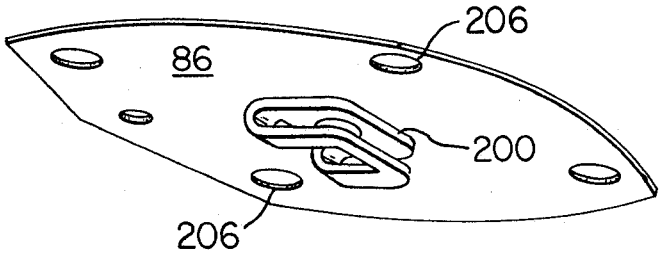
FIG. 19 is a perspective view of the diaphragm and connecting member FIG. 18.

Turning now to FIGS. 18 and 19, the diaphragm 86 is shown isolated and in greater detail. This diaphragm 86 has a centrally disposed bifurcated connecting member 200 which is secured to the underside of the diaphragm 86 through the agency of a rivet 202. The rivet 202 extends through the diaphragm 86 to interlock with a cup shaped washer 204 on the other side of the diaphragm 86. The diaphragm 86 also has a plurality of apertures 206 about its periphery for securing the diaphragm 86 to the nozzle body 12. The lever 168, illustrated in detail in FIG. 4*f*, is disposed between the bifurcated portions of connecting member 200 such that upward movement of diaphragm 86 forces similar upward movement of lever 168 to effectuate rotational movement of the clevis 166 about pivot pin 172. This relationship is perhaps best shown in FIGS. 1–3.

Figure 16:
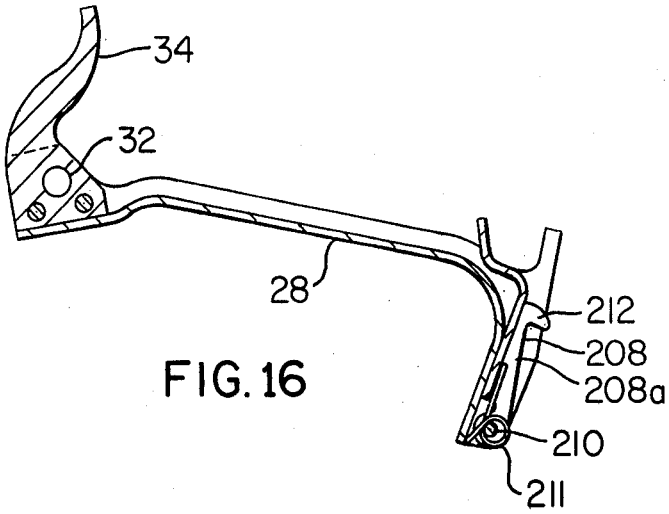
FIG. 16 is a cross sectional elevational view of the actuating lever used in the nozzle of FIGS. 1–3 with its attached actuating cam on one end and a "hold-open" clip on the other end.
Figure 17:
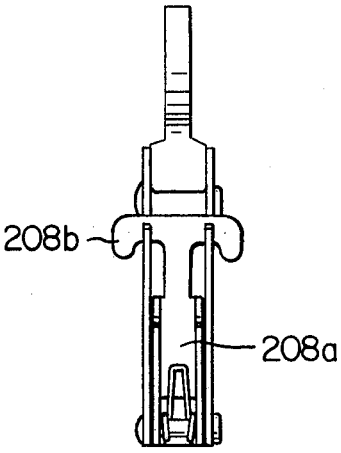
FIG. 17 is an end view of the actuating lever of FIG. 16.

FIGS. 16 and 17 show the manual lever 28 and the attached actuating cam 34 isolated from the nozzle body in greater detail. It is seen that the end of the lever 28 distal to the pivoting pin 32 has a spring biased automatic hold-open lever 208. This automatic hold-open lever 208 is pivotally mounted at pivot pin 210 where it is urged counterclockwise against the actuating lever 28 by a spring 211 coiled about the pin 210. The automatic hold-open lever 208 has a hook portion 212 which extends outwardly in generally perpendicular relationship to the main portion 208*a* of the hold-open lever extension. As shown in FIG. 17, the end of the hold-open lever most distal to the pivot pin 210 has outwardly extending wings 208*b* on both sides of the main lever portion 208*a*. The wings 208*b* are in generally perpendicular relationship to the main lever portion 208*a* as well as to the hook portion 212. As seen in any one of FIGS. 1 through 3, the guard 30 has a plurality of retaining pins 27 proximal to the arcuate swing of the lever 28. When it is desired to position the nozzle in an automatic fill mode, the hold-open lever is pivoted clockwise about pin 210 against the bias spring 211 so that hook portion 212 is hooked around one of the pins 27 (FIG. 1–3). When the lever is released, it will be moved clockwise slightly about pivot pin 32 so as to fully engage the hook 212 about one of the pins 27. This full engagement of the hook 212 about one of the pins 27 will hold the lever in the selected open position until the hook is disengaged from the pin 27, either manually by the operator or by virtue of operation of the automatic shut-off mechanism 38 described above.

Figures 13, 14, 15:
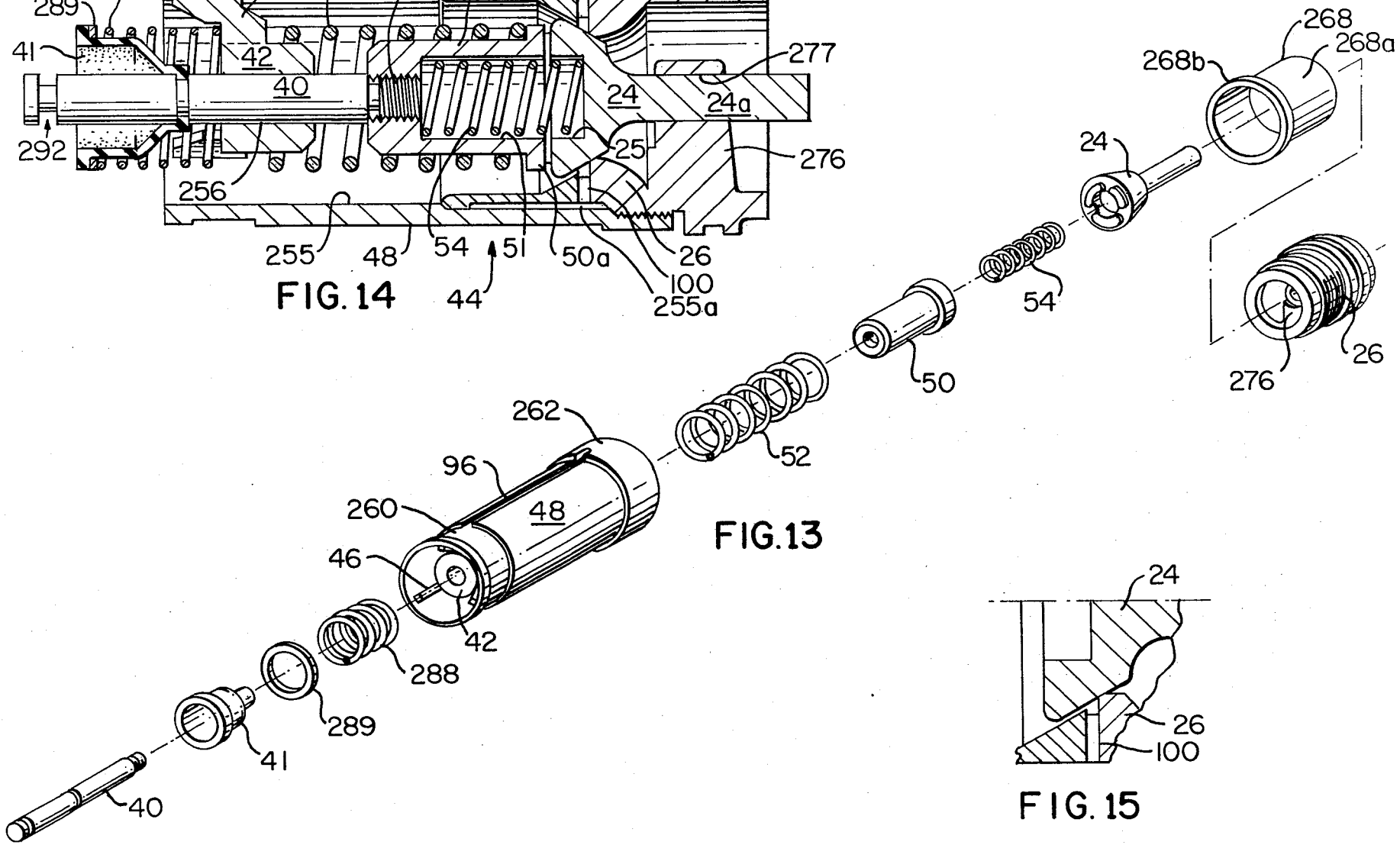
FIG. 13 is an exploded view of a poppet or body chamber module used in the nozzle of FIG. 1.
FIG. 14 is a cross sectional elevational view of the poppet or body chamber module of FIG. 13 as it is assembled illustrating the components in the nozzle of FIGS. 1–3, but depicting these components in greater detail.
FIG. 15 is an enlarged fragmentary view of the venturi area of the poppet or body chamber module of FIG. 14.

Referring now to FIG. 14, that illustration depicts the body chamber module or cartridge 44 illustrated in FIGS. 1–3 in greater detail as it is assembled, whereas FIG. 13 shows these same components in an exploded picturization. The body module 44 includes a cylindrical member or sleeve 48 which, in the assembled condition depicted in FIG. 14, houses most of the body chamber module's moving elements. This cylindrical member or sleeve 48 has a central fluid passage 255 which extends through the cylindrical member of sleeve 48. As mentioned above in connection with FIG. 1, cylindrical member or sleeve 48 contains a center hub or spider type stem guide 42 proximal to one end which is positioned in the center of the cylindrical body member 48. This center hub 42 contains a centrally disposed aperture 256 which is in alignment with the longitudinal axis of the body chamber module 44. The center hub 42 is supported in this center position by a plurality of legs or supports 46 which extend radially inward from the inner walls of the sleeve 48. The sleeve 48 has an annular slot of reduced diametral dimension 260 on its outer peripheral surface near the end of the sleeve 48 having a center hub 42. The opposite end of the sleeve 48 has an annular flange 262 of increased diametral dimension on its outer contour. The air passage 96 is shown to be formed by an axially extending slot or opening which extends along a substantial portion of the sleeve 48. This slot 96 extends into the annular flange 262 at which point it communicates with the interiallly disposed pressure chamber 98 which was discussed in connection with FIGS. 1–3.

The interior pressure chamber 98 is a space defined by the inner walls of the sleeve 48 and the outer walls of a bushing 268. As shown in either of FIGS. 13 or 14, the bushing 268 is axially advanced through the opening in the end of the sleeve 48 having the annular ridge 262. The bushing 268 also has a generally cylindrical shape with a main portion **268*a* having a first diametral dimension and with an end portion 268*b* having a second diametral dimension greater than that of portion 268*a*. This enlarged end portion 268*b* abuts the inner wall of the sleeve at a location determined by the length of a counterbore 255*a* interiorly formed in the sleeve 48 at the end opposite the center hub 42, the interface of the counterbore 255*a* with the fluid passage 255 (which has a lesser diameter than this counterbore) forming an abutment. The space between the main portion 268*a* of the bushing 268 and the inner walls of the cylindrical member 48 (at the location of the counterbore) form the pressure chamber 98 described above which communicates with the longitudinal slot 96. This communication is made through a bore 270**.

The annular flange or ridge 262 of the sleeve 48 has an interiorly threaded surface 272 which receives external threads on the outer periphery of the seat ring 26. The seat ring 26 has a stem support 276 which extends radially inward from the inner walls of the seat ring. This stem support 276 contains an opening 277 which is in axial alignment with the longitudinal axis of the body chamber module 44 whenever the seat ring 26 is threadably received by the cylindrical body member 48. The poppet valve 24 has a stem **24*a* which extends through the opening 277** for axially reciprocal movement.

The poppet valve 24 is selectively constrained in its axial movement by the cup shaped thimble member 50 which is also axially movable along the cylindrical members longitudinal axis. The thimble or cup shaped member 50 has a threaded opening in its end opposite the poppet valve 24 which accepts a matingly threaded end **40*a* of the stem 40. As shown most clearly in FIG. 14, the stem 40 extends through the aperture 256 of the center hub 42. The center hub 42, of course, supports the stem 40 for axially reciprocal movement of the cup like thimble member 50 to selectively limit axial movement of the poppet valve 24**.

The cup type thimble member 50 is urged against the poppet valve 24 by the compression spring 52 which is interposed between the annular flange **50*a* on the end of the thimble most proximal to the poppet valve 24 and the interface of the center hub 42 and the radial supports 46. A further compression spring 54 is positioned between the thimble type member 50 and the poppet valve 24 and is received in opposed spring receptive openings 51 and 25 in the thimble and the poppet valve 24** respectively.

A still further compression spring 288 envelops stem 40 on the other side of center hub 42 distal to the poppet valve 24. This still further compression spring 288 is positioned between the interface of the center hub 42 and its supporting members 46 on one side and a backup washer 289 which engages the stem seal 41 on the other end.

As it will also be noticed from a viewing of FIG. 14, the valve stem 40 has an annular notch 292 on its end portion opposite the cup like thimble member 50. This notch 292 is designed to receive side edge which define a slot 292' (FIG. 8) in the yoke 126 of the shut-off mechanism 38.

FIG. 15 shows an enlarged view of the venturi portion of the body module 48. As shown most clearly in this depiction, the poppet valve 24 engages the seat 26. Proximal to this seating location, a passageway 100 is provided which communicates between the annular interior pressure chamber 98 and the internal flow passage 14.

In operation, the dispensing nozzle of FIG. 1 is normally positioned to discharge gasoline into a fill tank with the spout 20 extending downwardly into the fill tank. When properly positioned, an operator manually compresses the lever 28 by rotating the lever 28 counterclockwise about pivot pin 32. This counterclockwise rotation of the lever 28 forces similar counterclockwise rotation of the attached actuating cam 34 so as to engage the actuating cam 34 with the roller 36 of the automatic shut-off mechanism 38. Continued counterclockwise rotation of the lever 28 and cam 34 forces the first linkage or anchor 132 of shut-off mechanism 38 to rotate about aligned pivot pins 160 and 162. Since anchor 132 is connected to links 110 and 112 by connecting pin 140 and since clevis 166 is in engagement with connecting member or roller 116 between links 110 and 112 preventing other than rotational movement of the roller 116 about its own axis, the links 110 and 112 are rotated about the axis of connecting member 116. The roller 116 or connecting member axis is coincident with that of pivot pins 160 and 162 so that the links 110 and 112 pivot about a common axis.

The counterclockwise rotation of links 110 and 112 compels movement of the attached yoke 126, which, in turn, forces leftward (in the illustration) movement of stem 40 and its attached thimble 50, the movement of the stem 40 and thimble 50 being generally rectilinear and being guided by stem guide 42. The movement of the stem 40 and thimble 50 is in a direction generally perpendicular to axes of the shut-off mechanism 38 and is achieved against the bias of compression spring 52.

When the thimble 50 is moved leftwardly, its restraining effect upon poppet valve 24 is partially removed. The poppet valve 24 is still, however, urged into a seated position by compression spring 54. The resistance offered by spring 54 is, however, substantially less than that of spring 52. The spring 54 is, in fact, designed to produce a force which will be less than that developed by the pressurized gasoline on the other side of the poppet valve 24. When so designed, the pressure differential forces poppet valve 24 to open against the bias of spring 54 whenever thimble 50 is moved from the poppet valve's 24 path. As the poppet valve 24 is opened, fluid is permitted to flow through the nozzle's internal flow passage 14 for discharge into the fill tank through the spout 20.

The operator may continue to discharge fluid through the nozzle by either continuing to hold lever 28 in an open position or by engaging one of the retaining pins 27 with hook portion 212 of the automatic hold open lever 208. So long as the pressurized force of the fluid being dispensed exceeds a predetermined threshold level necessary to overcome the bias of spring 54, the nozzle will continue to discharge the fluid until one of the two conditions is met. The fluid flow may be terminated by rotating the lever clockwise, either by releasing manual pressure on the handle or by disengaging the hold open lever 208 from the retaining pins (depending upon the mode in which the nozzle is operating). Fluid flow may also be terminated by reducing the pressure in chamber 82. This pressure in chamber 82 may also be reduced in two different ways.

As has been described previously, the chamber 82 is in fluid communication with both the venturi passage 100, on one side, and the opening 64 at the end of spout 20, on the other side. Whenever liquid flows through the internal flow passage 14 past poppet valve 24 and seat 26, a venturi effect is created and air is drawn from opening 64 to venturi passage 100. Under such conditions, since the chamber 82 is in air flow communication with the air passage from opening 64 to venturi passage 100, a partial vacuum exists in chamber 82. Air flow from opening 64 to venturi passage 100 may be terminated in two different ways. The liquid level of the tank being filled may rise to a height that blocks opening 64 from the atmosphere, terminating the air flow. Additionally, ball 72 in attitude chamber 70 may be moved under gravity bias to a blocking position which terminates the air flow. The ball 72 would be moved to such a position if the nozzle were accidentally dropped or otherwise placed in certain predetermined orientations.

Whatever the cause, whenever the air passage between opening 64 and venturi passage 100 is blocked, the partial vacuum in chamber 82 is increased due to air being drawn therefrom due to the venturi effect in venturi passage 100. The increase in the partial vacuum moves the diaphragm 86 upwardly against the bias of spring 90. This venturi effect is now widely known in the art and more particularly described in U.S. Pat. No. 3,085,600 to Briede.

The upward movement of the diaphragm 86 lifts lever 168 by virtue of that lever's (168) interconnection with bifurcated connecting member 200 attached to the diaphragm. The lever 168 is attached to clevis 166 and when the lever is so lifted, the clevis 166 is forced to pivot about pin 174, disengaging the clevis from roller 116. Being freed from engagement with clevis 166, links 110 and 112 rotate about pivot pin 140 from the position depicted in FIGS. 2 and 7 to the position depicted in FIGS. 3 and 8 under the influence of spring 52. The thimble 50 is thus moved rightwardly to once again close the poppet valve 25 against seat 26 and to terminate fluid flow through the nozzle 10.

Figure 20:
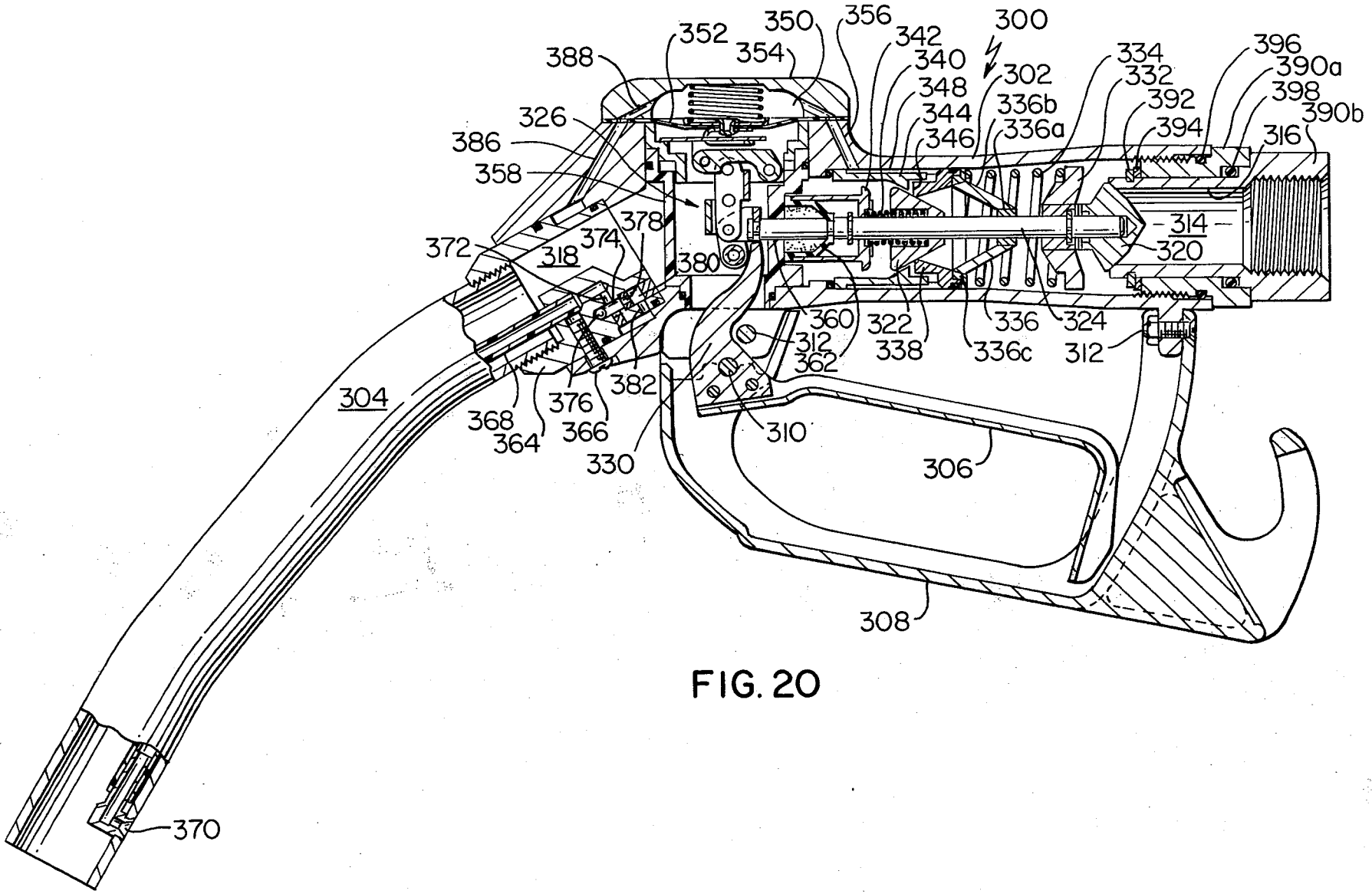
FIG. 20 is an elevational view, partially in cross section of an alternate embodiment of a dispensing nozzle utilizing the present invention.

An alternate embodiment of the present invention is illustrated in FIG. 20. A fluid dispensing nozzle 300 is shown with a body portion 302 and a spout 304. The nozzle 300 has a manually operated lever 306 pivotally attached to a guard 308 about a pivot pin 310. The guard 308 is, in turn, secured to the nozzle body 302 by suitable fastening means 312. The nozzle body 302 has an internal flow passage 314 which extends through the nozzle body 302 between an inlet 316 and an outlet 318.

Fluid flow through the internal flow passage 314 is controlled by a pair of poppet valves, a leader poppet 320 and a control poppet 322. Both of these valves 320 and 322 are supported upon a valve stem 324, in a manner that permits axial movement with respect to that stem 324. The stem 324 is attached to an actuating and shut-off mechanism 326 which is identical to the shut-off mechanism 38 in the previously described embodiment of FIGS. 1–19. For the reasons previously detailed in the foregoing description of actuating and shut-off mechanism 38, shut-off mechanism 326 causes generally rectilinear movement of the stem 324 in response to forces transmitted by an actuating cam 330 attached to lever 306. This rectilinear movement pulls a spider or retaining member 332 away from poppet valve 320 to permit the poppet valve 320 to open. In the relaxed position illustrated in FIG. 20, a compression spring 334 is interposed between the spider 332 and a stem guide 336 to urge the poppet valve to a closed position. The spring 334 produces a force which is greater than the counter-vailing force from the fluid pressure which is expected to be applied against the opposite upstream side of poppet valve 320.

The stem guide 336 has a center hub **336*a* having a central aperture to accommodate the stem 324. A plurality of legs 336*b* extend radially inward from a circular portion 336*c* of the stem guide closely fitted within the internal flow passage 314**.

Whenever the leader poppet 320 is opened, pressurized fluid is permitted to advance through the internal flow passage 314 to contact control poppet 322. The control poppet 322 is normally urged to a closed or seated position against a venturi seat 338 by a compression spring 340 which is coiled about stem 324 and which extends into a spring receptive opening in the control poppet 322 from a rigidly fixed secondary venturi member 342.

A deflector 344 is closely positioned on the downstream side of the venturi seat 338 along with venturi seat 338, form the venturi area. A venturi passage 346 is formed in the axial space between the seat 338 and deflector 344. This passage 346 provides communication with an annular chamber 348 between the outer periphery of the deflector and the interior circumferential surface of the nozzle body 302. The annular chamber 348 is in fluid communication with a chamber 350 formed between a diaphragm 352 and a cap 354 secured atop the nozzle body 302. This communication is by way of a passage 356.

The secondary venturi member 342 assists in opening control poppet valve 322 at higher flow rates. The flow between the secondary venturi member 342 and the deflector 344 creates a partial vacuum in the axial space between the venturi member 342 and control poppet valve 322, and this partial vacuum creates a force against the valve 322 to assist in overcoming the spring 340.

Like the embodiment of FIGS. 1–19, the shut-off mechanism 326 is modular and disposed within a carrier housing 358 which protects the mechanism 326 from the fluid flowing through internal flow passage 314 and keeps the mechanism 326 dry. The carrier housing 358 has an opening 360 through which the stem 324 extends. This opening 360 is sealingly protected against the fluid by a bellows type seal 362 sealingly engaged to both the stem 324 and carrier housing 358 and designed to collapse and expand as the stem is moved forward and away from the carrier housing 358.

The spout 304 is threadably secured to a spout adapter 364 which is fastened to the discharge or downstream end of the nozzle body 302 through the agency of a screw 366. A liquid level sensing line 368 provides fluid communication between a passage 370 in the spout and an opening 372 proximal to the discharge end of the spout 304. The passage 370 communicates by way of passage 372 with an attitude chamber 374 having a ball 376 constrained by its dimensions within the chamber 374. Through a series of joined air passages 378, 380, and 382, the attitude chamber 374 is joined to an annular chamber 384 between the spout adapter's (364) outer circumferential periphery and the nozzle body 302. The annular chamber 384 ultimately communicates with the chamber 350 through passages 386 and 388 in the body 302 and cap 354 respectively. As is thus seen, a plurality of passages join opening 372 with venturi passage 346 through intermediate chamber 350. The venturi system thus operates in a manner analogous to the previously described embodiment. Further, ball 376 in attitude chamber 374 corresponds in function and operation to ball 72 and chamber 70 of the previously described embodiment.

Also like the embodiment of FIGS. 1–19, the FIG. 20 embodiment has a swivel with a base portion **390*a* and a tail portion 390*b*. The base portion 390*a* is threadably inserted into the inlet 316 of internal flow passage 314. The tail portion 390*b* is rotatably fitted within the base portion 390*a* and is retained therein against axial movement by a retaining ring 392 secured into an annular slot on the outer periphery of the base portion 390*a*. The retaining ring 392 abuts a bearing surface 394 on the axial inboard surface of base portion 390*a*. O-rings 396 and 398 are positioned between the nozzle body 302 and base portion 390*a* and between the base end portions 390*a* and 380*b*** to provide fluid seals between these elements.

Significantly, the leader poppet 320 seats against the tail portion **390*b* of the swivel. By using the tail portion 390*b* as the seat, the seals between the swivel components and between swivel and the body 302 are protected against the full force of the pump pressure. Instead, in the illustrated arrangement of FIG. 20, the seals 396 and 398 are only exposed to dynamic pressure of the fluid after the leader poppet 320 is moved to an open or unseated position. Consequently, the fluid pressure applied against seals 396 and 398 is the dynamic pressure of the flowing fluid, a force which is considerably less than the static back pressure of the fluid under pump pressure. Even if the seals 396 and 398 were to leak, any leakage would be delayed until leader poppet 320 was unseated. Further, the pressure of the fluid after leader poppet 320** was opened would be that of the dynamically flowing fluid.

As will be realized from the foregoing description, the dispensing nozzle of the present invention has many advantageous features. The present invention provides a modular construction which greatly facilitates repair by a service station attendant. When repair on the nozzle is required the service station attendant may remove and replace one of several modules from the nozzle. The shut-off mechanism is contained within a housing for common removal with that housing from the nozzle body. This housing is removable by simply detaching the cap and removing the diaphragm. The housing containing the shut-off mechanism is then removed from the resulting opening.

Similarly, the body module containing the valve means is contained within a removable cartridge. The swivel portion of the nozzle is threadably removed from the body portion and the body module is removed as a unit. The spout is threadably connected to a spout adapter and this spout, including the spout and the attitude device is removed by unsecuring the fastening screw and removing the entire spout unit. The actuator including the lever and actuating cam is connected only to the guard. When the simple connecting nuts and bolts are removed, the guard and actuator are commonly removed from the nozzle body. Thus, the nozzle can be repaired in most circumstances by a relatively unskilled service station attendant with only commonly available tools such as a screwdriver and a pair of pliers.

It is also seen that the nozzle of the preferred construction opens with the flow of gasoline. This feature facilitates rapid termination of the fluid flow and makes it easier to "top off" i.e., to terminate flow between small incremental amounts of gasoline. This design of the nozzle also results in a relatively small pressure drop across the nozzle, a factor which further facilitates "topping off".

Thus, it is apparent that there has been provided, in accordance with the invention, a dispensing nozzle that satisfies the objects, aims and advantages set forth above. While the invention has been described in conjunction with specific embodiments thereof, it is evident that many alternatives, modifications, and variations will be apparent to those skilled in the art light of the foregoing description. Accordingly, it is intended to embrace all such alternatives, modifications and variations as fall within the spirit and broad scope of the appended claims.

What is claimed is:

1. A dispensing nozzle with an automatic shut-off mechanism, comprising:

(a) a nozzle body having an internal flow passage;

(b) a valve disposed in said internal flow passage for selectively blocking flow therethrough, said valve being movable between an open position in which fluid flow through the internal flow passage is permitted and a closed position in which fluid flow through the internal flow passage is substantially blocked;

(c) an actuator for moving the valve between open and closed positions under predetermined conditions;

(d) means for moving the valve to the closed position irrespective of the position of the actuator under other predetermined conditions, said moving means including:
(i) a plurality of independently rotatable members;
(ii) means for coupling said independently rotatable members for common rotational movement in response to movement of said actuator;
(iii) means for uncoupling said rotatable members in response to a predetermined condition; and
(iiii) means for rotating one of said rotatable members relative to the other when said members are uncoupled to move the valve to the closed position irrespective of the position of the actuator.

2. A dispensing nozzle as recited in claim 1 wherein said actuator is a manually operated lever rotatably attached with respect to said nozzle body.

3. A dispensing nozzle as recited in claim 1 further including means for rotating said independently rotatable members in common rotational movement about a first axis.

4. A dispensing nozzle as recited in claim 3 wherein said means for rotating said uncoupled rotatable members relative to each other rotates said members about a second axis substantially parallel to said first axis.

5. A dispensing nozzle as recited in claim 4 wherein said actuator is operative to rotate said rotatable members in a first rotational direction and said means for relatively rotating said members rotates one of said members in a second rotational direction which is opposite to the first rotational direction.

6. A dispensing nozzle as recited in claim 5 wherein said independently rotatable members includes a first linkage rotatably secured to the nozzle body and a second linkage member rotatably secured to the first linkage.

7. A dispensing nozzle as recited in claim 6 further including a movable stop selectively engagable with said second linkage, said stop being operative to prevent relative rotation between said first and second linkages when engaged with said second linkage.

8. A dispensing nozzle as recited in claim 7 further including means for disengaging said movable stop from said second linkage in response to predetermined conditions.

9. A dispensing nozzle as recited in claim 8 wherein said movable stop is rotatably secured relative to said nozzle body.

10. A dispensing nozzle as recited in claim 9 wherein said movable stop engages said second linkage on a first end of the second linkage spaced a predetermined distance from the rotational connection to the first linkage and further including a connecting member between said second linkage and said valve, said connecting member being rotatably connected to said second linkage on a second end of the second linkage which is on the opposite side of the pivotal connection from the first end.

11. A dispensing nozzle as recited in claim 10 further including a diaphragm which is movable in response to predetermined conditions, said movable stop being operatively connected to said diaphragm.

12. A dispensing nozzle as recited in claim 11 further including a lever interposed between said diaphragm and said movable stop to translate upward movement of said diaphragm into pivotal movement of said stop.

13. A dispensing nozzle as recited in claim 1 wherein said independently rotatable members includes:
(i) a movable stop;
(ii) a first linkage rotatably connected to the nozzle body at a first location about a first axis, said first linkage having an engagement surface on a portion remote from said first location;
(iii) a second linkage pivotally connected to the first linkage about a second axis substantially parallel to the first axis at a location intermediate of the first linkage's engagement surface and rotatable connection to the body, said second linkage having a retaining surface on the side of the pivotal connection to the first linkage opposite the engagement surface for selective engagement with the movable stop, said retaining surface being rotatable about said first axis when in engagement with said movable stop;
(iiii) means for rotating said second linkage relative to said first linkage about said second axis when said movable stop is disengaged from the retaining surface; and
(iiiii) means for translating movement of the second linkage to movement of the valve in a direction substantially perpendicular to the first and second axis.

14. A shut-off mechanism for a dispensing nozzle, comprising:
(a) a nozzle body having an internal flow passage;
(b) a valve movably disposed within said internal flow passage for selectively blocking fluid flow through the passage;
(c) a stop movable in response to predetermined conditions for selective engagement with a retaining surface;
(d) a first linkage rotatably connected to the nozzle body at a first location about a first axis, said first linkage having an engagement surface on a portion remote from said first location;
(e) a second linkage pivotally connected to the first linkage about a second axis substantially parallel to the first axis at a location intermediate of the first linkage's engagement surface and rotatable connection to the body, said second linkage having a retaining surface on one side of the pivotal connection to the first linkage for selective engagement with the movable stop, said retaining surface being rotatable about said first axis;
(f) means for rotating said second linkage relative to said first linkage about said second axis when said movable stop is disengaged from the retaining surface; and
(g) means for translating movement of the second linkage to movement of the valve in a direction substantially perpendicular to the first and second axis.

15. A shut-off mechanism as recited in claim 14 further including means for rotating said first and second linkages in common rotational movement about said first axis.

16. A shut-off mechanism as recited in claim 15 wherein said means for rotating said second linkage relative to said first linkage when said movable stop is disengaged rotates said first and second linkages about a second axis substantially parallel to said first axis.

17. A shut-off mechanism as recited in claim 16 further including an actuator operative to rotate said first and second linkages in common movement in a first rotational direction about said first axis.

18. A shut-off mechanism as recited in claim 17 wherein said means for rotating said second linkage relative to the first linkage rotates the second linkage in a second rotational direction opposite from said first rotational direction.

19. A shut-off mechanism as recited in claim 18 further including a connecting member connected to said valve and pivotally connected to said second linkage.

20. A dispensing nozzle, comprising:

(a) a body having an internal flow passage therethrough;

(b) an actuator relatively movable with respect to said body between open and closed positions;

(c) valve means movably disposed within the internal flow passage for selectively blocking fluid flow therethrough, said valve means having open and closed positions corresponding to said open and closed positions of said actuator and being responsive to and under control of said actuator under predetermined conditions; and (d) means for releasing said valve means from said control of said actuator in response to predetermined conditions; said releasing means being at least contained within a cartridge for common removal with the cartridge from the body.

21. A dispensing nozzle as recited in claim 20 wherein said cartridge is disposed in said flow passage with the releasing means contained within the cartridge and sealed from any fluid in the flow passage.

22. A dispensing nozzle as recited in claim 21 wherein said cartridge contains a side opening through which said valve means extends and a seal to prevent fluid from entering said opening.

23. A dispensing nozzle as recited in claim 22 wherein said cartridge has a bottom opening, said actuator extending through said bottom opening for interaction with said releasing means.

24. A dispensing nozzle as recited in claim 23 wherein said cartridge has a top opening and said releasing means is interconnected to a diaphragm which is movable in response to predetermined conditions, the movement of said diaphragm being operative to activate said releasing means for releasing the valve means from control of the actuator.

25. A dispensing nozzle of modular construction, comprising:

(a) a nozzle body having an internal flow passage;

(b) a valve assembly releasably fitted within said internal flow passage, said valve assembly including a valve movable between an open position which permits fluid flow through said internal flow passage and a closed position which blocks fluid flow through said internal flow passage, said valve assembly being contained within a valve cartridge for common removal of the valve assembly with the cartridge from the internal flow passage;

(c) an actuator for controlling the movement of said valve under predetermined conditions;

(d) a shut-off mechanism removably positioned within the nozzle body and operative to move the valve to its open position in response to movement of said actuator under predetermined conditions and to release the valve from control of the actuator under other predetermined conditions;

(e) a carrier housing, said shut-off mechanism being contained within said carrier housing for common removal with the carrier housing from the nozzle body, said carrier housing having a bottom opening; and (f) a guard member releasably secured to said nozzle body subjacent said shut-off mechanism, said actuator being pivotally connected to said guard member and extending through said bottom opening of said housing to interact with said shut-off mechanism, said actuator being unsecured to the nozzle body or shut-off mechanism and removable from the nozzle body with the guard member.

26. A dispensing nozzle as recited in claim 25 further including:

(a) a spout;

(b) a spout adapter which receives said spout, said spout adapter being releasably secured to said nozzle body so as to place the spout in fluid communication with said internal flow passage;

(c) a venturi in said internal flow passage proximal to said valve;

(d) an air passage communication between said venturi and an opening in said spout; and (e) means in said spout adapter movable under gravity bias for blocking said air passage whenever said nozzle is moved to a predetermined orientation.

27. A fluid dispensing nozzle, comprising:

(a) a nozzle body having an internal flow passage;

(b) a swivel connector for providing a sealed and rotatable connection between the internal flow passage in the nozzle body and an external flow conduit, said swivel connector including:

(i) a base portion received by said nozzle body and communicating with said internal flow passage; and (ii) a tail portion rotatably secured to said base portion and extending into said internal flow passage to form a valve seat, said tail portion being rotatably movable with respect to both said nozzle body and said base portion and being adapted to provide selective fluid communication between the internal flow passage and the external flow conduit; and (c) a valve movably disposed within said internal flow passage and movable between a first open position in which fluid flow through the internal flow passage is substantially unblocked and a second seated position in which said valve is seated against said tail portion.

28. A fluid dispensing nozzle as recited in claim 27 further including fluid seals between said nozzle body and said base portion and between said base portion and said tail portion, said tail portion serving to prevent exposure of fluid pressure in the external fluid conduit against said seals whenever the valve is in the seated position.

29. A fluid dispensing nozzle as recited in claim 27 wherein said base portion is threadably received by said nozzle body.

30. An easily serviced dispensing nozzle of modular construction which has an automatic shut-off mechanism, said nozzle comprising:

(a) a nozzle body having an internal flow passage therethrough;

(b) an actuator supported on said body and being relatively movable with respect to said body between open and closed positions;

(c) a cartridge having movable valve means therewithin including a poppet valve having a valve stem, said cartridge comprising an outer sleeve and a seat ring fastened at the upstream end of said outer sleeve and defining a unitary enclosing housing for most of the moving elements of said movable valve means, said poppet valve having its valve stem slidably supported upstream of its valve seat by said seat ring, said unitary enclosing housing enabling said cartridge with its movable valve means to be readily installed in and removed from said flow passage as a single unit, and said valve means having means for selectively blocking fluid flow through said flow passage and having open and closed positions corresponding to said open and closed positions of said actuator and being responsive to and under control of said actuator under predetermined conditions;

(d) means supporting said cartridge with said valve means therein within said flow passage; and (e) means for releasing said valve means from said control of said actuator in response to predetermined conditions;

said cartridge being adapted to be easily replaced by a relatively unskilled service station attendant using simple tools to thereby provide said nozzle having easily serviced valve means.

31. An easily serviced dispensing nozzle of modular construction which has an automatic shut-off mechanism, said nozzle comprising:

(a) a nozzle body having an internal flow passage therethrough;

(b) an actuator supported on said body and being relatively movable with respect to said body between open and closed positions;

(c) movable valve means disposed within said internal flow passage for selectively blocking fluid flow therethrough, said valve means having open and closed positions corresponding to said open and closed positions of said actuator and being responsive to and under control of said actuator under predetermined conditions;

(d) a cartridge which is adapted to be readily installed in and removed from said body and has means therein for releasing said valve means from said control of said actuator in response to predetermined conditions; and (e) means supporting said cartridge with said releasing means therein within said body;

said cartridge being adapted to be easily replaced by a relatively unskilled service station attendant using simple tools to thereby provide said nozzle having easily serviced releasing means.

32. An easily serviced dispensing nozzle of modular construction which has an automatic shut-off mechanism, said nozzle comprising:

(a) a nozzle body having an internal flow passage therethrough;

(b) An actuator supported on said body and being relatively movable with respect to said body between open and closed positions;

(c) a first cartridge which is adapted to be readily installed in and removed from said flow passage and has movable valve means therewithin, said valve means having means for selectively blocking fluid flow through said flow passage and having open and closed positions corresponding to said open and closed positions of said actuator and being responsive to and under control of said actuator under predetermined conditions;

(d) means supporting said first cartridge with said valve means therein within said flow passage;

(e) a second cartridge which is adapted to be readily installed in and removed from said body and has means therein for releasing said valve means from said control of said actuator in response to predetermined conditions; and (f) means supporting said second cartridge with said releasing means therein within said body;

said cartridges being adapted to be easily replaced by a relatively unskilled service station attendant using simple tools to thereby provide said nozzle having valve means and releasing means which are easily serviced.

33. A method of making an easily serviced dispensing nozzle of modular construction which has an automatic shut-off mechanism, said method comprising the steps of:

(a) providing a nozzle body;

(b) forming an internal flow passage through said body;

(c) supporting an actuator on said body which is relatively movable with respect to said body between open and closed positions;

(d) providing a cartridge which comprises the steps of providing an outer sleeve and fastening a seat ring to the upstream end of said outer sleeve to define a unitary enclosing housing for movable valve means of said dispensing nozzle;

(e) disposing most of the moving elements of said movable valve means which include a poppet valve having a valve stem within said cartridge by disposing said most of the moving elements within said enclosing housing with said valve stem slidably supported by said seat ring upstream of the valve seat for said poppet valve, said unitary enclosing housing enabling said cartridge with its movable valve means to be readily installed in and removed from said flow passage as a single unit, said valve means having means for selectively blocking fluid flow through said flow passage and having open and closed positions corresponding to said open and closed positions of said actuator and being responsive to and under control of said actuator under predetermined conditions;

(f) disposing said cartridge with said valve means therein within said flow passage, and (g) providing means for releasing said valve means from said control of said actuator in response to predetermined conditions;

said cartridge being adapted to be easily replaced by a relatively unskilled service station attendant using simple tools to thereby provide said nozzle having easily serviced valve means.

34. A method of making an easily serviced dispensing nozzle of modular construction which has an automatic shut-off mechanism, said method comprising the steps of:

(a) providing a nozzle body;

(b) forming an internal flow passage through said body;

(c) supporting an actuator on said body which is relatively movable with respect to said body between open and closed positions;

disposing movable valve means within said internal flow passage for selectively blocking fluid flow therethrough, said valve means having open and closed positions corresponding to said open and closed positions of said actuator and being responsive to and under control of said actuator under predetermined conditions;

(e) providing means for releasing said valve means from said control of said actuator in response to predetermined conditions;

(f) providing a cartridge which is readily installed in and removed from said body;

(g) disposing said releasing means within said cartridge; and (h) disposing said cartridge with said releasing means therein within said body;

said cartridge being adapted to be easily replaced by a relatively unskilled service station attendant using simple tools to thereby provide said nozzle having easily serviced releasing means.

35. A method of making an easily serviced dispensing nozzle of modular construction which has an automatic shut-off mechanism, said method comprising the steps of:

(a) providing a nozzle body;

(b) forming an internal flow passage through said body;

(c) supporting an actuator on said body which is relatively movable with respect to said body between open and closed positions;

(d) providing a first cartridge which is adapted to be readily installed in and removed from said flow passage (e) disposing movable valve means within said cartridge, said valve means having means for selectively blocking fluid flow through said flow passage and having open and closed positions corresponding to said open and closed positions of said actuator and being responsive to and under control of said actuator under predetermined conditions;

(f) disposing said first cartridge with said valve means therein within said flow passage;

(g) providing means for releasing said valve means from said control of said actuator in response to predetermined conditions;

(h) providing a second cartridge which is adapted to be readily installed in and removed from said body;

(i) disposing said releasing means within said second cartridge; and (j) disposing said second cartridge with said releasing means therein within said body;

said cartridges being adapted to be easily replaced by a relatively unskilled service station attendant using simple tools to thereby provide said nozzle having valve means and releasing means which are easily serviced.

36. A method as set forth in claim 35 in which said step of disposing said second cartridge within said body comprises disposing said second cartridge in said flow passage with said releasing means sealed from any fluid in said flow passage.

37. A method as set forth in claim 36 and comprising the further step of forming a side opening through said second cartridge for receipt of a portion of said valve means therethrough, extending said portion of said valve means through said side opening, and providing a fluid seal between said second cartridge and body around said side opening to prevent fluid from entering said side opening.

38. A method as set forth in claim 37 and comprising the further step of forming a bottom opening through said second cartridge for receipt of a portion of said actuator therethrough, and extending said portion of actuator through said bottom opening for interaction with said releasing means.

* * * * *